US006213310B1

(12) United States Patent
Wennersten et al.

(10) Patent No.: US 6,213,310 B1
(45) Date of Patent: Apr. 10, 2001

(54) ARRANGEMENT FOR HANDLING BANKNOTES

(75) Inventors: Pirjo Riitta Wennersten; Lars Harry Wennersten, both of Österskär (SE)

(73) Assignee: Cash and Change Control Sweden AB, Åkersberga (SE)

( * ) Notice: Subject to any disclaimer, the term of this patent is extended or adjusted under 35 U.S.C. 154(b) by 0 days.

(21) Appl. No.: 09/355,849

(22) PCT Filed: Feb. 10, 1998

(86) PCT No.: PCT/SE98/00228

§ 371 Date: Aug. 5, 1999

§ 102(e) Date: Aug. 5, 1999

(87) PCT Pub. No.: WO98/35324

PCT Pub. Date: Aug. 13, 1998

(30) Foreign Application Priority Data

Feb. 11, 1997 (SE) ..... 9700468

(51) Int. Cl.[7] ..... B07C 5/00

(52) U.S. Cl. ..... 209/534; 209/919; 198/469.1

(58) Field of Search ..... 209/534, 621, 209/919; 198/469.1, 470.1

(56) References Cited

U.S. PATENT DOCUMENTS 4,149,637 * 4/1979 Starr ..... 209/621
5,680,935 10/1997 Mistander et al. ..... 209/534
5,994,657 * 11/1999 Maier et al. ..... 209/919 X

FOREIGN PATENT DOCUMENTS 1449020 1/1969 (DE) .
3136610 3/1983 (DE) .
0604880 7/1994 (EP) .
0615643 9/1994 (EP) .
1353415 * 11/1987 (SU) ..... 209/919

* cited by examiner

*Primary Examiner*—Tuan N. Nguyen
(74) *Attorney, Agent, or Firm*—Browdy and Neimark

(57) ABSTRACT

An arrangement for handling banknotes having a banknote magazine (10) which is arranged to permit banknotes (39) to be fed into as well as out from the magazine one by one, and a memory device (44) for storing continuously updated information about the contents of the magazine (10). The banknote magazine has a controllably rotatable drum (10), containing a plurality of separate magazine compartments (11), formed by sector-like pockets, each of which extends in a generally radial direction into the drum (10) from an opening (27) located at the periphery of the drum. Through rotation of the drum (10), a selectable magazine compartment (11) can be placed with its opening (27) in front of an infeed and/or outfeed station (17, 19, 21) in order to permit an infeed of a banknote into or an outfeed of a banknote from said compartment (11) by an infeed and outfeed device (28), located within the magazine compartment (11) and serving also to hold a banknote fed into the magazine compartment (11) within the latter.

5 Claims, 3 Drawing Sheets

ARRANGEMENT FOR HANDLING BANKNOTES

CROSS REFERENCE TO RELATED APPLICATION

Figure 1:
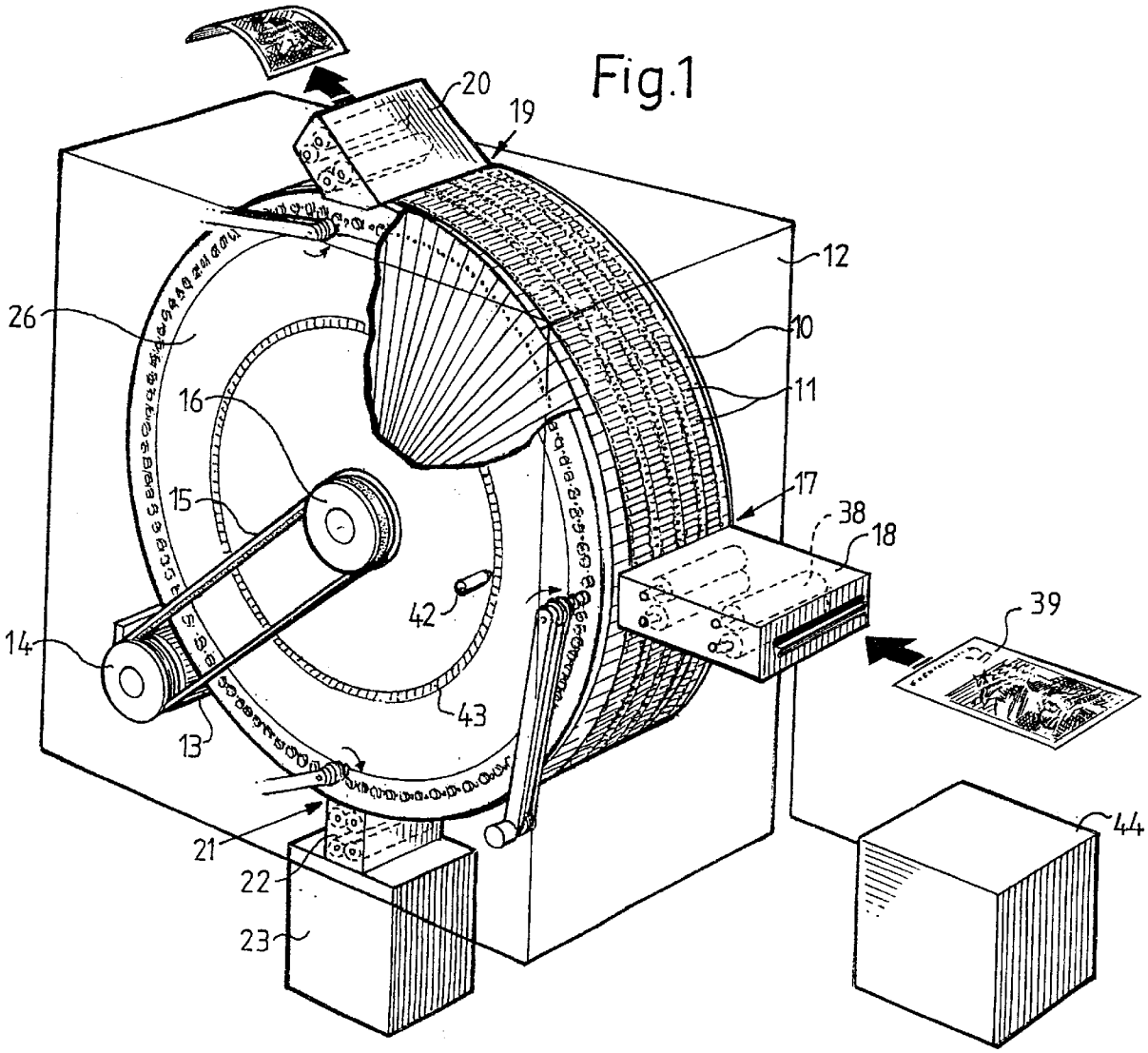

The present application is the national stage under 35 U.S.C. 371 of PCT/SE98/00228, filed Feb. 10, 1998.

The present invention relates to an arrangement for handling banknotes.

More particularly, the invention relates to such an arrangement of the kind comprising a banknote magazine, which is arranged to permit the banknotes to be fed in into as well as out from the magazine one by one, detector means, which are arranged to detect each infeed of a banknote into and each outfeed of a banknote from the magazine, and memory means, which are arranged to store information about the contents of the magazine that is updated continuously in connection with the infeed of banknotes into and the outfeed of banknotes from the magazine.

Banknote handling arrangements of said kind are utilized inter alia with cash registers in shops or the like but may be used also in other connections, for instance in payment machines.

A banknote handling arrangement of the kind is previously known through EP-B1 0 615 643. This known arrangement is provided with a number of banknote magazines, each of which is formed by two tapes, extending each from one supply spool to a location where the two tapes are brought together and placed one upon the other in order then to be wound up jointly on a magazine spool. At the location where the two tapes are brought together, banknotes may be fed in one by one and one after the other between the two tapes in order then to be wound up on the magazine spool while being held between the two tapes. As a consequence of this design of the banknote magazine, banknotes may be fed out from each separate magazine only in an order reversed in relation to the order in which they have been fed in into the magazine. For this reason, each banknote magazine can be utilized only for one single type of banknotes. Therefore, the arrangement is provided with one separate banknote magazine for each banknote type which it is intended to handle. As a result, the arrangement as a whole is very bulky and it requires a space which in many cases is unaccetably large.

A banknote handling arrangement which eliminates the above need for separate banknote magazines for banknotes of different types and makes it possible to use one single banknote magazine for storing banknotes of different types is disclosed in Swedish patent application No. 95 01180-5. Even this arrangement is based on the utilization of co-operating tapes between which the banknotes may be inserted in order then to be wound up on a magazine spool while being held between two tapes. In order to facilitate an outfeed of a banknote of a selectable type from the banknote magazine, the magazine comprises on the one hand a first tape which extends between two different magazine spools, and on the other hand two additional tapes, one of which is arranged to be wound up on one of the magazine spools together with said first tape, while the other one is arranged to be wound up on the other magazine spool together with said first tape. The arrangement as a whole is very complicated. Moreover, its structure is such that it cannot be expected to operate in a reliable and unobjectionable manner if it is charged with banknotes which, as often is the case in practice, have serious deficiencies, for instance in the shape of heavy folds, torn edges or spots of sticky material occurring on the banknotes.

The invention has for its object to provide an improved banknote handling arrangement of the kind initially specified, which avoids the above disadvantages of the arrangement previously proposed.

The arrangement, according to the invention proposed for this purpose, is primarily characterized in that the banknote magazine comprises a controllably rotatable drum, containing a plurality of separate, individually identifiable magazine compartments which are formed each by one sector-like pocket, extending in a generally radial direction into the drum from a combined infeed and outfeed opening of the magazine compartment in question, located at the periphery of the drum, in that, through rotation of the drum, a magazine compartment, selected in view of the stored information, can be placed with its said opening in front of at least one infeed and/or outfeed station in order to permit an infeed of a banknote into and/or an outfeed of a banknote from said compartment at said station, in that each magazine compartment is arranged to receive only one banknote therein, and in that each magazine compartment is provided with combined infeed and outfeed means, located adjacent to said opening thereof, for forcibly feeding in a banknote into and forcibly feeding out a banknote from the magazine compartment and holding a banknote, fed in into the magazine compartment, within the same.

The invention makes it possible to use the banknote magazine for storing banknotes of a plurality of different types and it simultaneously also guarantees that the infeed of banknotes into the magazine and the outfeed of banknotes therefrom may take place in a very safe and reliable manner also when damaged or smeared banknotes occur among the banknotes handled by the arrangement.

In accordance with a preferred embodiment of the invention, said infeed and outfeed means of each compartment may preferably comprise at least one pair of rotatable rollers which are arranged to be brought into frictional engagement with mutually opposite sides of a banknote.

Moreover, adjacent to each infeed and/or outfeed station, the arrangement may suitably be provided with drive means for controllably driving said infeed and outfeed means of a magazine compartment having its said opening located in front of the station in question.

The arrangement may preferably comprise an infeed station, provided with a banknote reader, and at least one separate outfeed station, in which case the drum may be arranged to be placed with a selectable magazine compartment in a position in front of a selectable one of said stations. Hereby, it is possible to avoid that banknotes fed out from the magazine have to pass through the banknote reader provided at the infeed station.

Furthermore, the arrangement may suitably comprise two different outfeed stations, one of which is arranged to be utilized for repayment purposes, while the other one is arranged to permit a transfer of banknotes from the magazine to a storage cassette. By this arrangement, it is possible to reduce the required size of the banknote magazine, since any surplus of banknotes appearing in the magazine during the use of the arrangement may be transferred from the magazine to the storage cassette.

Figure 2:
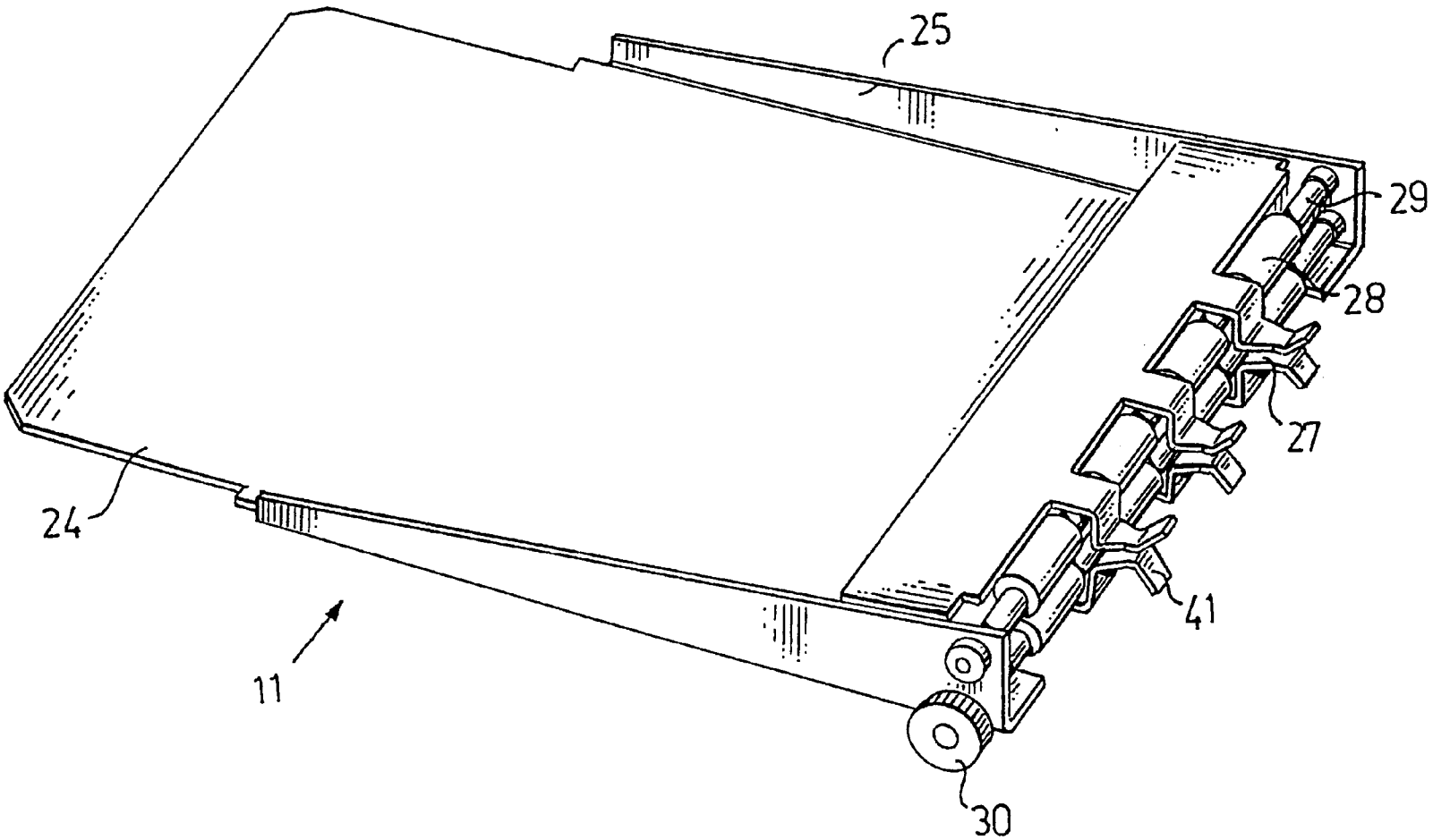
Figure 3:
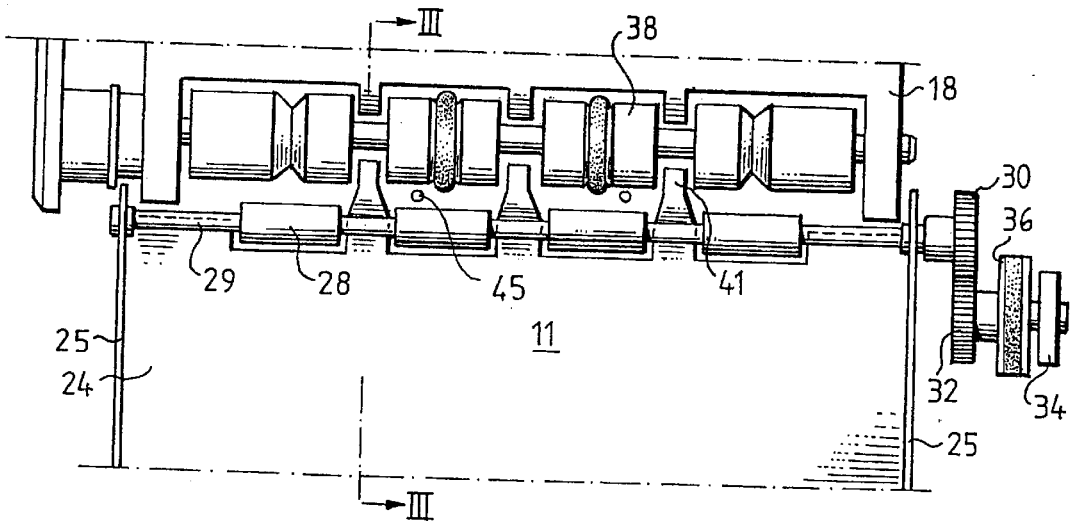
Figure 4:
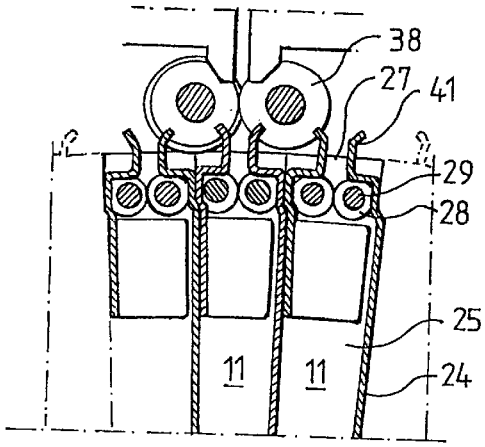
Figure 5:
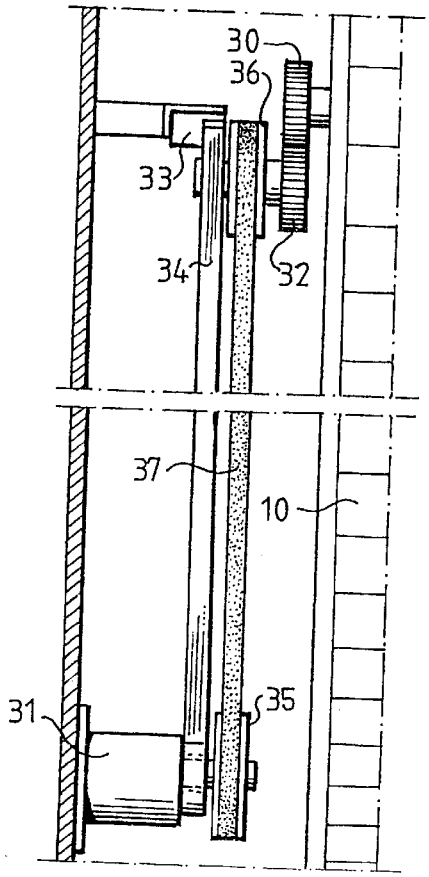

Below the invention is further described with reference to the accompaying drawings, in which:

FIG. 1 shows a diagrammatic perspective view of a banknote handling arrangement according to an embodiment of the invention, selected by way of example, FIG. 2 shows a perspective view of a magazine compartment of a banknote magazine forming part of said arrangement and containing a plurality of separate magazine compartments, FIG. 3 shows a partial view, illustrating an outer portion of a magazine compartment located in a position in front of a banknote reader provided at an infeed station of the arrangement, FIG. 4 shows a section, taken along line IV—IV in FIG. 3, and FIG. 5 shows a partial view, illustrating a drive for controllably driving combined infeed and outfeed means of a magazine compartment.

The banknote handling arrangement shown in the drawings comprises a banknote magazine 10, having the general shape of a rotatably mounted cylindrical drum which is provided with a plurality of separate magazine compartments 11 for receiving only one banknote in each compartment. Magazine compartments 11 are formed as sector-like pockets, extending in radial directions into drum 10 from combined infeed and outfeed openings 27 of the different magazine compartments which are evenly distributed along the periphery of the drum.

Magazine drum 10 is contained within a surrounding casing 12 which prevents unauthorized access to the drum. Tn order to make it possible to rotate the drum 10 in a controllable manner, a driving motor 13 is mounted at the inner side of casing 12 and coupled to the drum through a belt transmission, comprising a pulley 14 mounted on the output shaft of motor 13, a driving belt 15 and a pulley 16 mounted on a central shaft of the drum.

Reference numeral 17 generally designates an infeed station where banknotes may be fed into banknote magazine 10 through a banknote reader 18. Reference numeral 19 generally designates a first outfeed station where banknotes may he fed out from drum 10 For repayment purposes via an outfeed device 20, and reference numeral 21 generally designates a second outfeed station where banknotes may be transferred to a storage cassette 23 via a further outfeed device 22. By means of driving motor 13 and the belt transmission connected to said motor, magazine drum 10 can be rotated in order to locate opening 27 of a selected magazine compartment 11 in front of any of said stations 17, 19 and 21.

The more detailed construction of the drum-shaped banknote magazine appears from FIGS. 2, 3 and 4 As may be seen from said drawing figures, each magazine compartment 11 is formed by a sheet metal piece which comprises a plane main portion 24, extending substantially along the whole axial length of magazine drum 10, and two generally sector-shaped side wall portions 25, formed by two opposite edge flanges which extend perpendicular to main portion 24 and towards the adjacent magazine compartment. In the illustrated case, magazine compartments 11 are assumed to be connected to each other by means of two end wall plates 26 which are provided at opposite ends of magazine drum 10 and to which side wall portions 25 are secured in any suitable manner, for instance through welding.

Adjacent to its combined infeed and outfeed opening 27, each magazine compartment 11 is provided with combined infeed and outfeed means, located within said compartment and formed by four pairs of rotatable rollers 28 which, within each pair, are arranged to be brought into frictional engagement with mutually opposite sides of a banknote. Rollers 28, which may consist of rubber of any other suitable material, are supported by two parallel shafts 29 which are rotatably mounted in the two side wall portions 25. At its one end, one of said shafts projects in a lateral direction from magazine drum 10 and carries a tooth wheel 30. In order to make it possible to rotate this tooth wheel 30 and hence also rollers 28 of a magazine compartment located in front of one of stations 17, 19 and 21, a drive is provided adjacent to each of said stations, said drive comprising a driving motor 31 and a driving wheel 32 which is mounted at the outer end of an arm 34, swingable by means of an electromagnet 33, and which may be driven from motor 31 through a belt transmission comprising two pulleys 35 and 36 and a driving belt 37. By swinging arm 347 toothed driving wheel 32 can be moved between an inactive position, in which it is out of engagement with any of tooth wheels 30, and an active position, in which it is in engagement with tooth wheel 30 of a magazine compartment 11 located in front of station 17, 19 or 21, respectively.

In addition to a radially outer portion of magazine drum 10, FIGS. 3 and 4 also show an adjacent portion of a banknote reader 18 which, as indicated in FIG. 1, is provided with two sets of controllably rotatable rollers 38 which are spaced apart in the longitudinal direction of the banknote reader and by means of which a banknote 39 may be fed through the banknote reader and to a magazine compartment 11, located in front of said reader, in order then to be fed into said compartment with the aid of the rollers 28 of said compartment. Corresponding sets of controllably rotatable rollers 38 are provided also in each of the two outfeed devices 20 and 22 in order to permit a banknote discharged from a magazine compartment 11 to be fed out through said device.

In order to facilitate a correct transfer of a banknote to or from a magazine compartment 11, at its radially outer end, each magazine compartment is provided with three pairs of radially projecting guide tongues 41 which are located at a short distance from each other in the peripheral direction of the magazine drum and which define constricted portions of the infeed and outfeed opening 27 of the compartment in question.

In order to make it possible to determine the existing rotary position of magazine drum 10, as diagrammatically indicated in FIG. 1, said drum may for instance be provided with a code circle 43, co-operating with a fixed optical or magnetic sensor 42 and serving to identify the magazine compartment 11 at a given instant located in front of banknote reader 18 or any of the two outfeed devices 20 and 22. Moreover, at each one of the infeed and outfeed stations formed by banknote reader 18 and outfeed devices 20 and 22, electrooptical detector means are provided for detecting each correctly effected infeed of a banknote into or outfeed of a banknote from banknote magazine 10. FIG. 3 diagramatically shows such detector means 45 provided at the transition between banknote reader 18 and magazine compartment 11.

The manner of operation of the banknote handling arrangement described above is as follows.

When a banknote 39 is to be fed in into banknote magazine 10, an arbitrarily chosen unoccupied magazine compartment 11 is placed in a position in front of infeed station 19 and the banknote reader 18 located at said station. Simultaneously, information about the identity of the magazine compartment in question is delivered to a combined control and monitoring unit 44. Hereupon, banknote reader 18 is activated and feeds banknote 39 into compartment 11 after having determined the denomination of the banknote and checked its genuiness. The banknote is then forcibly fed into compartment 11 by means of the rollers 28 of said compartment. Under the control of detector means 45, the infeed of the banknote into compartment 11, obtained by means of rollers 28, is interrupted when the banknote has been released from banknote reader 18 but still has an outer portion thereof located between rollers 28 which hereby will hold the banknote in a position such as to make it possible at a later stage easily to feed out the banknote from compartment 11 by rotating rollers 28 in directions opposite to the directions in which they are rotated during the infeed of the banknote. When the infeed of the banknote has been completed, corresponding information is delivered to unit 44 which contains memory means, arranged to store information about the banknote contents of the magazine which is updated continuously in connection with each infeed of a banknote into and each outfeed of a banknote from magazine 10 and which consists of individual information about the contents of each separate magazine compartment.

When, instead, a banknote of a certain desired denomination is to be fed out from magazine 10 at any of the two outfeed stations 19 and 21, magazine drum 10 is rotated under the control of unit 44 to a position in which a magazine compartment 11 containing a banknote of the desired denomination is located in front of the selected outfeed station. Hereupon, the banknote is fed out from said compartment and through the outfeed device 20 or 22, respectively, provided at said station. When the outfeed of the banknote has been completed, this fact is detected by the detector means located at the station in question and corresponding information is delivered to unit 44 in order to update the information stored in the memory means of said unit.

The invention is not restricted to the embodiment above described and shown in the drawings. Instead, many other embodiments are feasible within the scope of the invention as defined in the claims.

What is claimed is:

1. An arrangement for handling banknotes, said arrangement being of the kind comprising a banknote magazine (10), which is arranged to permit banknotes (39) to be fed in into as well as out from the magazine one by one, detector means (45), which are arranged to detect each infeed of a banknote into and each outfeed of a banknote from the magazine (10), and memory means (44), which are arranged to store information about the contents of the magazine that is updated continuously in connection with (he infeed of banknotes into and the outfeed of banknotes from the magazine (10), characterized in that the banknote magazine comprises a controllably rotatable drum (10), containing a plurality of separate, individually identifiable magazine compartments (11) which are formed each by one sector-like pocket, extending in a generally radial direction into the drum (10) from a combined infeed and outfeed opening (27) of the magazine compartment (11) in question, located at the periphery of the drum, in that, through rotation of the drum (10), a magazine compartment (11), selected in view of the stored information, can be placed with its said opening (27) in front of at least one infeed or outfeed station (17, 19, 21) in order to permit an infeed of a banknote into or an outfeed of a banknote from said compartment (11) at said station (17, 19, 21), in that each magazine compartment (11) is arranged to receive only one banknote (39) therein, and in that each magazine compartment (11) is provided with combined infeed and outfeed means (28), located adjacent to said opening (27) thereof, for forcibly feeding in a banknote into and forcibly feeding out a banknote from the magazine compartment (11) and holding a banknote, fed in into the magazine compartment.

2. An arrangement according to claim 1, characterized in that said infeed and outfeed means of each magazine compartment (11) comprise at least one pair of rotatable rollers (28) which are arranged to be brought into frictional engagement with mutually opposite sides of a banknote.

3. An arrangement according to claim 1, chatracterized by drive means (30–37), provided at each infeed or outfeed station (17, 19, 21), for controllably driving said infeed and outfeed means (28) of a magazine compartment (11) having its said opening (27) located in front of the station (17, 19, 21) in question.

4. An arrangement according to claim 1, characterized in that it comprises an infeed station (17), provided with a banknote reader (18), and at least one separate outfeed station (19, 21), the drum (10) being arranged to be placed with a selectable magazine compartment (11) in a position in front of a selectable one of said stations (17, 19, 21).

5. An arrangement according to claim 4, characterized in that it comprises two separate outfeed stations (19, 21), one (19) of which is arranged to be utilized for repayment purposes, while the other one (21) is arranged to permit a transfer of banknotes from the magazine (10) to a storage cassette (23).

* * * * *